US009353977B2

(12) United States Patent
Gao et al.

(10) Patent No.: US 9,353,977 B2
(45) Date of Patent: May 31, 2016

(54) PULSE TUBE REFRIGERATOR WITH AN AUTOMATIC GAS FLOW AND PHASE REGULATING DEVICE

(75) Inventors: Jinlin Gao, Jiangsu (CN); Ao Li, Jiangsu (CN); Wenqing Dong, Jiangsu (CN); Wei Chao, Jiangsu (CN); Jie Chen, Jiangsu (CN)

(73) Assignee: CSIC PRIDE (NANJING) CRYOGENIC TECHNOLOGY CO., LTD., Jianging Economic and Technological Development Zone, Nanjing, Jiangsu (CN)

( * ) Notice: Subject to any disclaimer, the term of this patent is extended or adjusted under 35 U.S.C. 154(b) by 363 days.

(21) Appl. No.: 13/979,218

(22) PCT Filed: Jan. 16, 2012

(86) PCT No.: PCT/CN2012/070427

§ 371 (c)(1), (2), (4) Date: Jul. 11, 2013

(87) PCT Pub. No.: WO2013/044604

PCT Pub. Date: Apr. 4, 2013

(65) Prior Publication Data

US 2013/0291566 A1 Nov. 7, 2013

(30) Foreign Application Priority Data

Sep. 29, 2011 (CN) ..... 2011 1 0300559

(51) Int. Cl.
*F25B 9/00* (2006.01)
*F25B 9/14* (2006.01)

(52) U.S. Cl.
CPC ..... *F25B 9/145* (2013.01); *F25B 2309/1413* (2013.01); *F25B 2309/1418* (2013.01); *F25B 2309/1425* (2013.01)

(58) Field of Classification Search
CPC .. F25B 9/145; F25B 9/10; F25B 2309/14241; F25B 2309/1413
See application file for complete search history.

(56) References Cited

U.S. PATENT DOCUMENTS

2009/0151803 A1* 6/2009 Longsworth ..... F16K 31/041 137/630.21
2011/0094244 A1* 4/2011 Xu ..... F25B 9/145 62/6
2012/0085121 A1* 4/2012 Longsworth ..... F25B 9/14 62/403
2012/0096873 A1* 4/2012 Webber ..... F25D 19/006 62/48.1

* cited by examiner

*Primary Examiner* — Jonathan Bradford
*Assistant Examiner* — Elizabeth Martin
(74) *Attorney, Agent, or Firm* — Tianhua Gu; Global IP Services

(57) ABSTRACT

A pulse tube refrigerator with an automatic gas flow and phase regulating device is composed by a helium compressor, an air distribution valve, a drive controller, a drive lead, a temperature sensor, a temperature measuring lead, a heat regenerator, a first-stage pulse tube, a second-stage pulse tube, a first-stage air reservoir and a second-stage air reservoir, wherein the air distribution valve is consisted of eight independent valves. According to received temperature signals from the temperature sensors the drive controller transmits order signals to the eight independent valves so as to control the open/close degree, time and sequence of the eight valves of the air distribution valve.

3 Claims, 4 Drawing Sheets

PULSE TUBE REFRIGERATOR WITH AN AUTOMATIC GAS FLOW AND PHASE REGULATING DEVICE

CROSS REFERENCE TO RELATED PATENT APPLICATION

The present application is the US national stage of PCT/CN2012/070427 filed on Jan. 16, 2012, which claims the priority of the Chinese patent application No. 201110300559.2 filed on Sep. 29, 2011, which application is incorporated herein by reference.

FIELD OF THE INVENTION

The invention relates to a low temperature pulse tube refrigerator with an automatic gas flow and phase regulating device, in particular a pulse tube refrigerator with an automatic gas flow and phase regulating device.

BACKGROUND OF THE INVENTION

As no moving component is provided in the cold finger part, the pulse tube refrigerator is much more reliable compared with the traditional G-M refrigerator and the Sterling refrigerator; the cold finger has advantages of no wear, low vibration, low noises and so on and has extensive commercial application values.

The pulse tube refrigerator can be regarded as the variant of the G-M refrigerator which takes place the solid piston with the gas piston and obtains refrigeration effect via the insulating discharge and expansion process of the high pressure gas in the hollow cavity of the pulse tube.

The work process thereof comprises:

1) Air intake process: The inlet valve is open, the high pressure gas flows through the heat regenerator, the cold end heat regenerator and the fluid director via the valves, enters into the pulse tube in laminar flow way and pushes the gas in the tube toward the closed end. The gas is extruded and enable the gas temperature in the closed end of the pulse tube to reach the maximum value.
2) Heat exchange process: The water cooler installed in the closed end of the pulse tube takes the heat away so as to reduce the temperature of the gas in the tube to the original temperature when entering the heat regenerator.
3) Air discharge process: The discharge valve is open and is connected with the low pressure air pipe, the gas in the pulse tube is expanded to generate refrigeration effect, the temperature of the gas is reduced to the minimum temperature.
4) Heat regenerator process: The expanded low pressure gas flows through the heat regenerator reversely, absorbs the heat in the filler, goes back to the compressor inlet and finishes a circulation. Refer to FIG. 1.

The general expression of the refrigerating capacity of expansion refrigeration by the gas in the pulse tube is as follows:

$$\dot{Q}=\int p d\dot{V}$$

The refrigerating capacity thereof is determined by the pressure p reaching in the pulse tube, flow v and the phase relation between them. In the G-M pulse tube refrigerator, the phase relation between the pressure and flow can be interpreted as the relative time span of the gas compression process or expansion process.

No moving component is provided in the cold end of the pulse tube refrigerator, therefore the flow and phase of the gas entering the pulse tube cannot be regulated actively; an active air distribution device must be provided in order to obtain an ideal relation between the flow and phase at super low temperature, for example the double-stage pulse tube refrigerator with six valves for actively air distribution as shown in FIG. 2.

The plane rotary valves are used as the traditional air distribution valves, and the valves are designed on a moving device. Once the design and manufacture of the plane rotary valves are finished, the gas flow and open/close time and sequence of the valves cannot be changed; when the refrigeration temperature is changed by working condition changes, the refrigerator cannot reach the best operating parameter by regulating the flow and phase of the gas. In addition, during the operation process, if dusts enter into the pipes, for example the holes and pipes of the two-way inlet valve, the flow coefficient will be changed, thereby the flow and phase of the gas in the refrigerator is changed and deviated from the best operation parameter of the original design.

As the refrigeration temperature of the pulse tube refrigerator is easily influenced by many factors such as change of the environment temperature, impurity in the internal gas and direction of the cold finger, unstable situations occur easily in the operation process. Therefore, the flow and phase of the gas entering the heat regenerator or pulse tube need to be regulated respectively in accordance with these factors during the operation process of the refrigerator so as to regulate the performance of the refrigerator, enable the refrigerator to be in the optimized working condition and enhance the efficiency of the refrigerator and stability of the refrigeration temperature.

SUMMARY OF THE INVENTION

As the performance of the existing pulse tube is easily influenced by the temperature of the environment and the operation condition, the purpose of the present invention is to provide a pulse tube refrigerator with an automatic gas flow and phase regulating device which can automatically regulate the flow and phase of the gas in accordance with the change of the working condition of the refrigerator so as to regulate the performance of the refrigerator, enable the refrigerator to be in the optimized working condition and enhance the efficiency of the refrigerator and stability of the refrigeration temperature.

Technical proposal of the invention is as follows:

A low temperature pulse tube refrigerator with an automatic gas flow and phase regulating device, comprising a helium compressor, an air distribution valve, a drive controller, a drive lead, a temperature sensor, a temperature measuring lead, a heat regenerator, a first-stage pulse tube, second-stage pulse tube, a first-stage air reservoir and a second-stage air reservoir; said air distribution valve comprises eight independent valves of a first valve, a second valve, a third valve, a fourth valve, a fifth valve, a sixth valve, a seventh valve and an eighth valve; the drive controller transmits order signals to said eight independent valves via the drive lead so as to control the open/close degree, time and sequence of said eight valves in the air distribution valve; outlets of the heat regenerator are respectively connected with the fifth valve and the sixth valve which are respectively connected with the helium compressor and the low pressure air pipe; outlets in the top part of the first-stage pulse tube are respectively connected with the third valve, the fourth valve and the eighth valve; the third valve and the fourth valve are respectively connected with a high pressure air pipe and low pressure air pipe of the helium compressor; outlets in the top part of the second-stage pulse tube are respectively connected with the first valve, the second valve and the seventh valve, the first valve and the second valve are respectively connected with the high pressure air pipe and low pressure air pipe; the bottom parts of the first-stage pulse tube and the second-stage pulse tube are respectively connected with the bottom parts of the first-stage heat regenerator and the second-stage heat regenerator via a second connecting pipe and a first connecting pipe.

The open/close time, sequence and degree of the eight valves in said air distribution valve are controlled by the drive controller; the drive controller respectively transmits the control signals to the eight independent valves of the first valve, the second valve, the third valve, the fourth valve, the fifth valve, the sixth valve, the seventh valve and the eighth valve via the drive lead.

The bottom parts of said first-stage heat regenerator and second-stage heat regenerator are respectively attached to a second temperature sensor and a first temperature sensor; the temperature signal output ends of the second temperature sensor and the first temperature sensor are connected to the temperature signal receiving end of the drive controller via the temperature measuring lead and regulate the open/close time, sequence and degree of the valves in accordance with the temperature signals.

Said seventh valve is independently connected between the second-stage air reservoir and the second-stage pulse tube.

Said eighth valve is independently connected between the first-stage air reservoir and the first-stage pulse tube.

Advantages of the Invention

The air distribution valve of the invention comprises eight independent valves which are not influenced by each other; the drive controller can independently regulate the open/close time, sequence and degree of each valve in accordance with the testing refrigeration temperature signal so as to control the degree, time and sequence of the gas entering/exiting the heat regenerator, the first-stage pulse tube and the second-stage pulse tube, realize in-time regulation of the phase and flow of the gas during the operation process of the refrigerator and maintain stability of the performance of the refrigerator, thus the limitation of the traditional plane rotary valve on the active distribution function is removed.

DESCRIPTION OF THE PREFERRED EMBODIMENTS

The invention is further described as follows with combination of attached figures.

Figure 1:
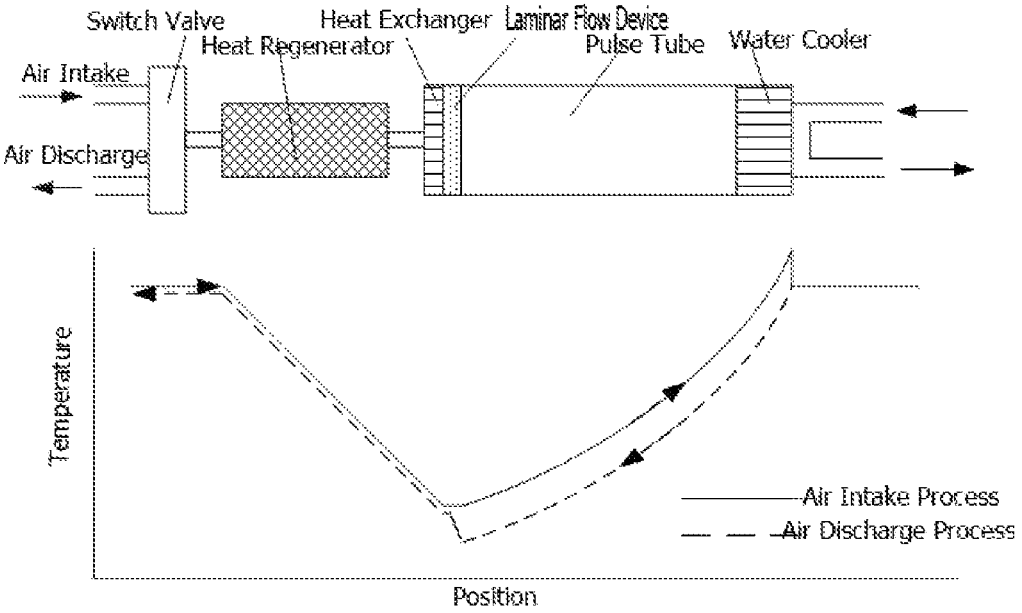
Fig. 1 (PRIOR ART)
FIG. 1 is a temperature distribution map in the circulation process of the basic pulse tube refrigerator in the prior art.
Figure 2:
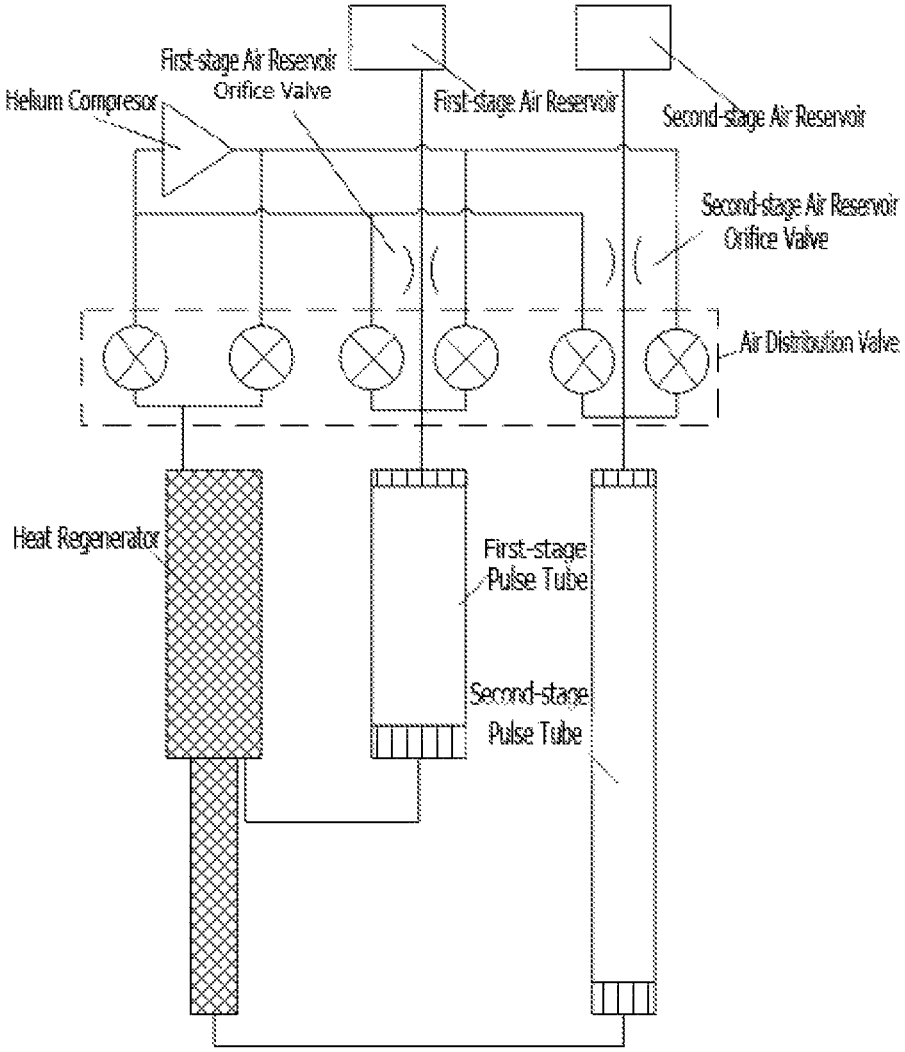
Fig. 2 (PRIOR ART)
FIG. 2 is a double-stage pulse tube refrigerator with six valves for active air distribution in the prior art.
Figure 3:
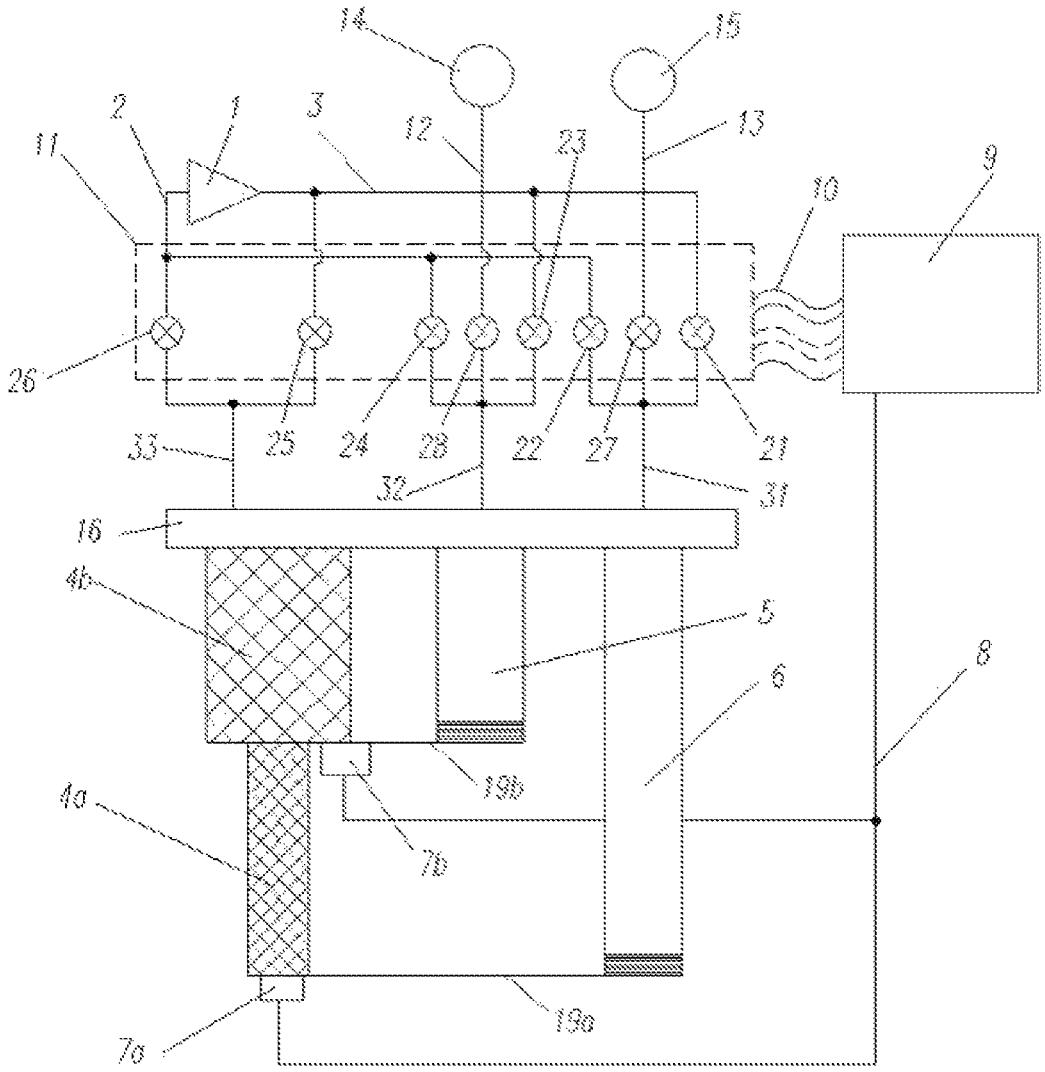
FIG. 3 a schematic diagram of the pulse tube refrigerator with an automatic gas flow and phase regulating device in the present invention.
Figure 4:
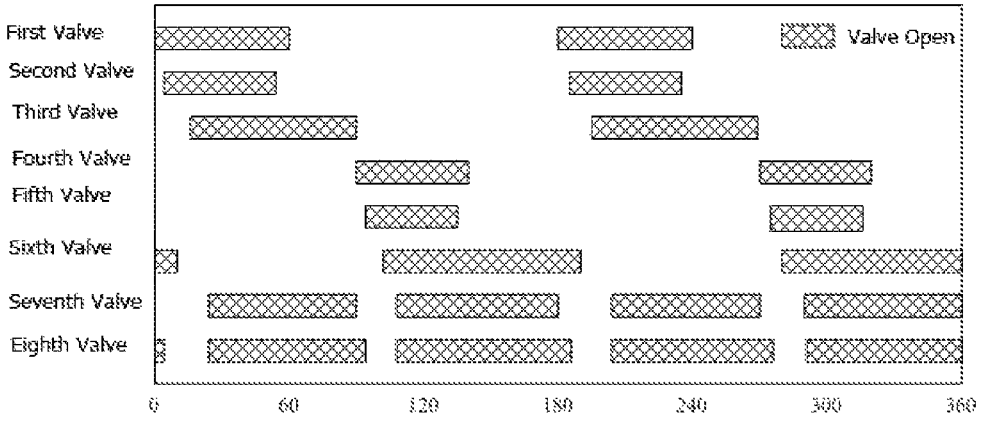
FIG. 4 is a schematic diagram of the open/close times and sequences of the valves of the refrigerator in the present invention.

As shown in FIGS. 3 and 4, said bottom part and top part are the directions in accordance with the figures.

A low temperature pulse tube refrigerator with an automatic gas flow and phase regulating device, comprising a helium compressor 1, an air distribution valve 11, a drive controller 9, a drive lead 10, a temperature sensor, a temperature measuring lead 8, a heat regenerator, a first-stage pulse tube 5, a second-stage pulse tube 6, a first-stage air reservoir 14 and a second-stage air reservoir 15.

Said air distribution valve 11 comprises eight independent valves of a first valve 21, a second valve 22, a third valve 23, a fourth valve 24, a fifth valve 25, a sixth valve 26, a seventh valve 27 and an eighth valve 28 which have no influence to each other; the drive controller 9 transmits order signals to said eight independent valves via the drive lead 10 so as to control the open/close degree, time and sequence of said eight valves in the air distribution valve 11; outlets of the heat regenerator 4 are respectively connected with the fifth valve 25 and the sixth valve 26 which are respectively connected with the helium compressor 1 and a low pressure air pipe 2; outlets in the top part of the first-stage pulse tube 5 are respectively connected with the third valve 23, the fourth valve 24 and the eighth valve 28; the third valve 23 and the fourth valve 24 are respectively connected with a high pressure air pipe 3 and low pressure air pipe 2 of the helium compressor 1; outlets in the top part of the second-stage pulse tube 6 are respectively connected with the first valve 21, the second valve 22 and the seventh valve 27, the first valve 21 and the second valve 22 are respectively connected with the high pressure air pipe 3 and low pressure air pipe 2; the bottom parts of the first-stage pulse tube 5 and the second-stage pulse tube 6 are respectively connected with the bottom parts of a first-stage heat regenerator 4*b* and a second-stage heat regenerator 4*a* via a second connecting pipe 19*b* and a first connecting pipe 19*a*.

The open/close time, sequence and degree of the eight valves in said air distribution valve 11 are controlled by the drive controller 9; the drive controller 9 respectively transmits the control signals to the eight independent valves of the first valve 21, the second valve 22, the third valve 23, the fourth valve 24, the fifth valve 25, the sixth valve 26, the seventh valve 27 and the eighth valve 28 via the drive lead 10.

The bottom parts of said first-stage heat regenerator 4*b* and second-stage heat regenerator 4*a* are respectively attached to a second temperature sensor 7*b* and a first temperature sensor 7*a*; the temperature signal output ends of the second temperature sensor 7*b* and the first temperature sensor 7*a* are connected to the temperature signal receiving end of the drive controller 9 via the temperature measuring lead 8 and regulate the open/close time, sequence and degree of the valves 21 to 28 in accordance with the temperature signals.

Said seventh valve 27 is independently connected between the second-stage air reservoir 15 and the second-stage pulse tube 6.

Said eighth valve 28 is independently connected between the first-stage air reservoir 14 and the first-stage pulse tube 5.

In the specific embodiment, the first-stage heat regenerator 4*b* and the second-stage heat regenerator 4*a* are coaxially connected to form a stepped shape. The top parts of the first-stage heat regenerator 4*b*, the first-stage pulse tube 5 and the second-stage pulse tube 6 can be installed on the flange simultaneously.

In the specific embodiment, the gas enters and exists in the top part of the first-stage heat regenerator 4*b* via pipes 33; the pipes 33 are divided into two parallel parts and are respectively connected in series with the fifth valve 25 and the sixth valve 26, said two valves are respectively connected with the high pressure air pipe 3 and low pressure air pipe 2 of the helium compressor 1 to control the entrance and exit of the gas in the top part of the first-stage heat regenerator 4*b*. The bottom parts of the first-stage pulse tube 5 and second-stage pulse tube 6 are respectively connected with the bottom parts of the first heat regenerator 4*b* and the second-stage heat regenerator 4*a* via the second connecting pipe 19*b* and the first connecting pipe 19*a*; the gas entering/exiting the first-stage heat regenerator 4*b* is divided into two parts in the bottom part of the first-stage heat regenerator 4*b*, one part of the gas enters/exits the first-stage pulse tube 5 via the second connecting pipe 19*b*, the other part of the gas enters/exits the second-stage pulse tube 6 through the second-stage heat regenerator 4*a* and the first connecting pipe 19*a*.

In the specific embodiment, the gas enters/exits in the top part of the first-stage pulse tube 5 via pipes 32, the pipes 32 are divided into three parallel branches, each branch is respectively connected in series with the third valve 23, the fourth valve 24 and the eighth valve 28; the third valve 23 and the fourth valve 24 are respectively connected with the high pressure air pipe 3 and the low pressure air pipe 2 of the helium compressor 1; the eighth valve 28 is connected with the first-stage air reservoir 14; the outlet in the top part of the second-stage pulse tube 6 is connected with a pipe 31; the pipe 31 is divided into three parallel branches, each branch is respectively connected in series with the first valve 21, the second valve 22 and the seventh valve 27, the first valve 21 and the second valve 22 are respectively connected with the high pressure air pipe 3 and the lower pressure air pipe 2; the second-stage air reservoir 15 is connected with the first valve 27.

The bottom parts of the first-stage heat regenerator 4*b* and the second-stage heat regenerator 4*a* are respectively attached to the second temperature sensor 7*b* and the first temperature sensor 7*a* to measure the first-stage refrigeration temperature and the second-stage refrigeration temperature.

The automatic gas flow and phase regulating device comprises: eight independent valves—the first valve 21, the second valve 22, the third valve 23, the fourth valve 24, the fifth valve 25, the sixth valve 26, the seventh valve 27, the eighth valve 28, the drive controller 9, the first temperature measuring sensor 7*a*, the second temperature measuring sensor 7*b* and the temperature measuring lead 8.

As the first valve 21, the second valve 22, the third valve 23, the fourth valve 24, the fifth valve 25, the sixth valve 26, the seventh valve 27 and the eighth valve 28 are independent to each other, the flow and phase of the gas entering the heat regenerator can be regulated independently via the fifth valve 25 and the sixth valve 26; the flow and phase of the gas entering the second-stage pulse tube 6 can be regulated via the first valve 21, the second valve 22 and the seventh valve 27; the flow and phase of the gas entering the first-stage pulse tube 5 can be regulated via the third valve 23, the fourth valve 24 and the eighth valve 28.

When the working condition of the refrigerator is changed, the refrigeration temperature will be changed, the temperature sensor 7 transmits the temperature change signal to the drive controller 9 in accordance with the change signal, the drive controller 9 will send orders to said eight independent valves respectively in accordance with the change situation of the temperature signal and regulate the open degree of said eight independent valves so as to control the gas flow; in addition the relative open/close time of said eight independent valves also can be changed to regulate the relative time of entering/existing of the gas so as to regulate the gas phase During the application, the output order signals of the drive controller 9 can be set as manual output or automatic output in accordance with the requirements. For the former one, corresponding open-loop control box or panel can be designed in advance, the open/close degree, time and sequence of the eight independent valves can be programmed to be an adjustable program to manually debug in the experiment process; for the latter one, the test signal and control signals can be programmed to a corresponding program in accordance with the change rule obtained from the experiment and input into the drive controller 9 so as to automatically regulate the flow and phase of the gas entering the heat regenerator or pulse tube, thus to realize the automatic control function, enable the refrigerator to be in the optimized work condition and enhance the efficiency of the refrigerator and the stability of the refrigeration temperature.

The invention is applicable to any low temperature refrigerators which need periodical air distribution, including G-M refrigerator, G-M pulse tube refrigerator and Solveen refrigerator; when the invention is applied on G-M pulse tube refrigerators, the effect is particularly significant.

What is claimed is:

1. A low temperature pulse tube refrigerator with an automatic gas flow and phase regulating device comprising:

a helium compressor (1), an air distribution valve (11), a drive controller (9), a drive lead (10), a temperature sensor, a temperature measuring lead (8), a heat regenerator, a first-stage pulse tube (5), a second-stage pulse tube (6), a first-stage air reservoir (14) and a second-stage air reservoir (15);

said air distribution valve (11) comprises eight independent valves of a first valve (21), a second valve (22), a third valve (23), a fourth valve (24), a fifth valve (25), a sixth valve (26), a seventh valve (27) and an eighth valve (28);

outlets of the heat regenerator (4) are respectively connected with the fifth valve (25) and the sixth valve (26) which are respectively connected with the helium compressor (1) and a low pressure air pipe (2); outlets in the top part of the first-stage pulse tube (5) are respectively connected with the third valve (23), the fourth valve (24) and the eighth valve (28), the third valve (23) and the fourth valve (24) are respectively connected with a high pressure air pipe (3) and the low pressure air pipe (2) of the helium compressor (1); outlets in the top part of the second-stage pulse tube (6) are respectively connected with the first valve (21), the second valve (22) and the seventh valve (27), the first valve (21) and the second valve (22) are respectively connected with the high pressure air pipe (3) and low pressure air pipe (2); the bottom parts of the first-stage pulse tube (5) and the second-stage pulse tube (6) are respectively connected with the bottom parts of the first-stage heat regenerator (4*b*) and a second-stage heat regenerator (4*a*) via a second connecting pipe (19*b*) and a first connecting pipe (19*a*);

wherein, a second temperature sensor (7*b*) attached to the bottom of the first-stage heat regenerator (4*b*) and a first temperature sensor (7*a*) attached to the bottom of the second-stage heat regenerator (4*a*), temperature signal output ends of the second temperature sensor (7*b*) and the first temperature sensor (7*a*) are connected to a temperature signal receiving end of the drive controller (9) via the temperature measuring lead (8);

according to received temperature signals from the first and second temperature sensors the drive controller (9) transmits order signals to said eight independent valves via the drive lead (10) so as to control the open/close degree, time and sequence of said eight valves in the air distribution valve (11);

thereby, flow and phase of the gas are automatically regulated in accordance with changes of working conditions and an optimized working condition and a stability of the refrigeration temperature are achieved.

2. The low temperature pulse tube refrigerator with the automatic gas flow and phase regulating device according to claim 1, wherein said seventh valve (27) is independently connected between the second-stage air reservoir (15) and the second-stage pulse tube (6).

3. The low temperature pulse tube refrigerator with the automatic gas flow and phase regulating device according to claim 1, wherein said eighth valve (28) is independently connected between the first-stage air reservoir (14) and the first-stage pulse tube (5).

* * * * *